US008409776B2

(12) United States Patent
Kitagawa

(10) Patent No.: US 8,409,776 B2
(45) Date of Patent: Apr. 2, 2013

(54) TONER FOR DEVELOPING ELECTROSTATIC IMAGE, METHOD FOR PREPARING TONER FOR DEVELOPING ELECTROSTATIC IMAGE, DEVELOPER FOR ELECTROSTATIC IMAGE, TONER CARTRIDGE, PROCESS CARTRIDGE, IMAGE FORMING METHOD, AND IMAGE FORMING APPARATUS

(75) Inventor: Soichiro Kitagawa, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 200 days.

(21) Appl. No.: 13/081,948

(22) Filed: Apr. 7, 2011

(65) Prior Publication Data

US 2012/0115080 A1 May 10, 2012

(30) Foreign Application Priority Data

Nov. 4, 2010 (JP) ..... 2010-247804

(51) Int. Cl.
*G03G 9/08* (2006.01)

(52) U.S. Cl. ..... 430/108.9; 430/111.4; 430/137.14; 399/252

(58) Field of Classification Search ..... 430/108.9, 430/111.4, 137.14; 399/252
See application file for complete search history.

(56) References Cited

FOREIGN PATENT DOCUMENTS

| | | |
|---|---|---|
| JP | A-09-218534 | 8/1997 |
| JP | A-10-288865 | 10/1998 |
| JP | A-2006-309035 | 11/2006 |

*Primary Examiner* — Mark A Chapman
(74) *Attorney, Agent, or Firm* — Oliff & Berridge, PLC

(57) ABSTRACT

A toner for developing an electrostatic image, contains a binder resin having an acid value of from approximately 10 mgKOH/g to approximately 20 mgKOH/g and carbon black having a surface carboxyl group density of from approximately $2\times10^{-6}$ mol/m to approximately $8\times10^{-6}$ mol/m$^2$, and is prepared in an aqueous medium.

20 Claims, 1 Drawing Sheet

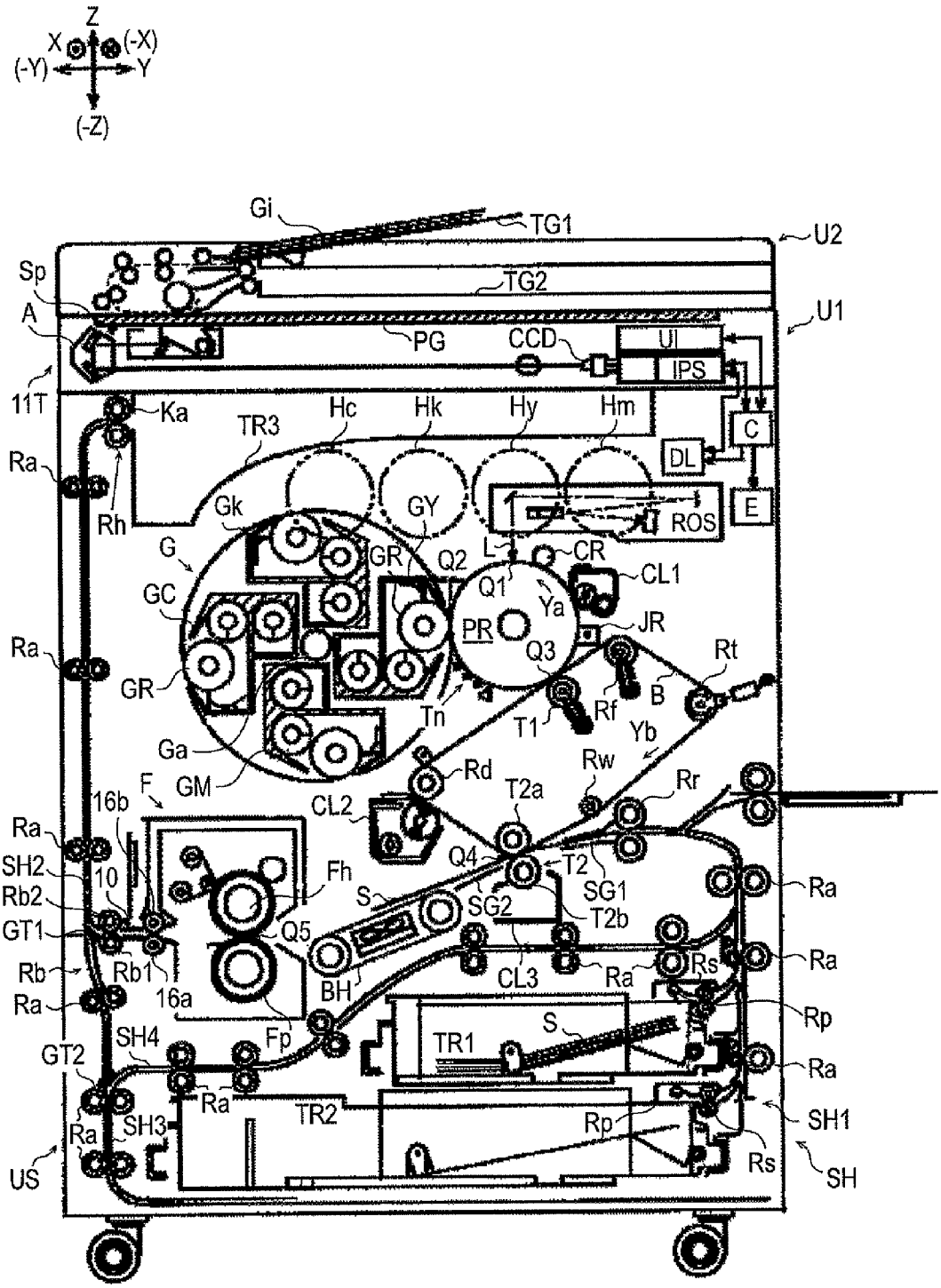
Z
X
(-X)
(-Y)
Y
(-Z)
Gi
TG1
U2
Sp
TG2
A
U1
PG
CCD
UI
IPS
11T
Ka
Hc
Hk
Hy
Hm
TR3
C
DL
Ra
Rh
Gk
GY
E
ROS
G
GR
Q2
L
CR
CL1
GC
Q1
Ya
PR
JR
Q3
Rt
GR
Tn
T1
Rf
B
Yb
Ga
Rd
Rw
GM
T2a
Rr
F
16b
CL2
Q4
T2
SH2
10
Fh
SG1
Rb2
S
SG2
T2b
GT1
Q5
Rb
Rb1
BH
CL3
Rs
16a
Rp
SH4
Fp
TR1
GT2
TR2
SH1
SH3
US
SH

TONER FOR DEVELOPING ELECTROSTATIC IMAGE, METHOD FOR PREPARING TONER FOR DEVELOPING ELECTROSTATIC IMAGE, DEVELOPER FOR ELECTROSTATIC IMAGE, TONER CARTRIDGE, PROCESS CARTRIDGE, IMAGE FORMING METHOD, AND IMAGE FORMING APPARATUS

CROSS-REFERENCE TO RELATED APPLICATIONS

This application is based on and claims priority under 35 USC 119 from Japanese Patent Application No. 2010-247804 filed Nov. 4, 2010.

BACKGROUND

1. Technical Field

The present invention relates to a toner for developing an electrostatic image, a method for preparing the toner for developing an electrostatic image, a developer for an electrostatic image, a toner cartridge, a process cartridge, an image forming method, and an image forming apparatus.

2. Related Art

A method of visualizing image information through an electrostatic image by an electrophotographic process or the like is currently applied to various fields of art. In the electrophotographic process, an electrostatic image (electrostatic latent image) is formed on a photoconductor (image holding member) through charging and exposing, and the electrostatic image is developed with a developer containing a toner, and then visualized through transferring and fixing. The developer used herein includes a two-component developer containing a toner and a carrier, and a single-component developer using a magnetic toner or a non-magnetic toner solely. The toner is generally prepared by a mixing and pulverizing method, in which a thermoplastic resin is melted and kneaded with a pigment, a charge controlling agent and a releasing agent such as wax, and the mixture is cooled, finely pulverized and then classified. The toner may contain, depending on necessity, inorganic or organic particles added to the surface of the toner particles for improving the flowability and the cleaning property.

SUMMARY

According to an aspect of the invention, there is provided a toner for developing an electrostatic image, including a binder resin having an acid value of from approximately 10 mgKOH/g to approximately 20 mgKOH/g and carbon black having a surface carboxyl group density of from approximately $2\times10^{-6}$ mol/m$^2$ to approximately $8\times10^{-6}$ mol/m$^2$, and being prepared in an aqueous medium.

BRIEF DESCRIPTION OF THE DRAWING

Exemplary embodiments of the present invention will be described in detail based on the following FIGURE, wherein:

FIG. 1 is a schematic cross sectional view showing an example of an image forming apparatus according to an exemplary embodiment of the invention.

DETAILED DESCRIPTION

Exemplary embodiments of the invention will be described in detail below. The invention is not limited to the exemplary embodiments and may be practiced with various modifications unless the substance of the invention is impaired.

Toner for Developing Electrostatic Image

A toner for developing an electrostatic image (which may be hereinafter referred simply to a toner) according to the exemplary embodiment contains a binder resin having an acid value of from approximately 10 mgKOH/g to approximately 20 mgKOH/g and carbon black having a surface carboxyl group density of from approximately $2\times10^{-6}$ mol/m$^2$ to approximately $8\times10^{-6}$ mol/m$^2$, and is prepared in an aqueous medium.

The constitutional materials of the toner, the preparation method of the toner, and the like according to the exemplary embodiment will be described below.

Carbon Black

The toner for developing an electrostatic image of the exemplary embodiment contains carbon black having a surface carboxyl group density of from $2\times10^{-6}$ mol/m$^2$ or approximately $2\times10^{-6}$ mol/m$^2$ to $8\times10^{-6}$ mol/m$^2$ or approximately $8\times10^{-6}$ mol/m$^2$.

Examples of a method for measuring the surface carboxyl group density of the carbon black in the exemplary embodiment include the following method.

A sample is measured for a volume median particle size with Microtrack Particle Size Analyzer (available from Nikkiso Co., Ltd.).

A dispersion of the sample is then measured for a solid content with a moisture analyzer (HB43-S, available from Mettler-Toledo International, Inc.), and the dispersion in an amount corresponding to a solid content of 5 g is collected to a beaker. Distilled water is added to the beaker to make 100 g, to which 1 g of a surfactant (Dowfax, available from Dow Chemical Company) is added. The dispersion is measured for pH with a pH meter (SG2, available from Mettler-Toledo International, Inc.), and a 0.3 M nitric acid aqueous solution is added thereto until the pH reaches 2.

After the pH reaches 2, the beaker is mounted on an automatic titrator (AUT-701, available from DKK-TOA Corporation, in which a titration reagent is a 0.1 M sodium hydroxide aqueous solution dropped per 0.1 mL, and the titration is finished at pH 11), and alkalimetry is performed.

The difference (d (ph)/d(b)), in which b represents the dropped amount of the sodium hydroxide aqueous solution, i.e., the variation of pH per dropped amount, is calculated from the data set of the dropped amount of the sodium hydroxide aqueous solution b and the pH. In the plot of the pH and the difference (d(ph)/d(b)), the first maximal value is designated as the start point of dissociation of carboxyl group, and the second maximal value is designated as the end point of dissociation of carboxyl group. The carboxyl group amount per 1 g of the sample is calculated by assuming that the dropped amount of the sodium hydroxide aqueous solution consumed between the start point and end point is entirely consumed for dissociation of carboxyl group. The surface area per 1 g of the sample is calculated from the volume median particle size, and the amount of carboxyl group per surface area (mol/m$^2$) is calculated therefrom and is designated as the surface carboxyl group density.

The surface carboxyl density of the resin particles or the like is also measured in the similar manner as above.

The surface carboxyl group density of the carbon black used in the exemplary embodiment is from $2\times10^{-6}$ mol/m$^2$ or approximately $2\times10^{-6}$ mol/m$^2$ to $8\times10^{-6}$ mol/m$^2$ or approximately $8\times10^{-6}$ mol/m$^2$, preferably from $3\times10^{-6}$ mol/m$^2$ or approximately $3\times10^{-6}$ mol/m$^2$ to $7\times10^{-6}$ mol/m$^2$ or approximately $7\times10^{-6}$ mol/m$^2$, and more preferably from $4\times10^{-6}$ mol/m$^2$ or approximately $4\times10^{-6}$ mol/m$^2$ to $6\times10^{-6}$ mol/m$^2$ or approximately $6\times10^{-6}$ mol/m$^2$. When the surface carboxyl group density is in the range, the carbon black has good dispersibility in the toner, and thus the toner has excellent transferring property under a high temperature and high humidity environment.

The carboxyl group on the surface of the carbon black used in the exemplary embodiment may be bonded directly to the surface of the carbon black or may be bonded thereto through a linking group, and preferably bonded through a linking group.

The method for introducing a carboxyl group to the surface of the carbon black is not particularly limited, and examples of the method include an acid treatment of the surface with an acid, such as an inorganic acid and an organic acid, a surface oxidation treatment with an oxidant, such as ozone and potassium permanganate, and a surface modification treatment with a radical generating agent having a carboxyl group.

Among these methods, it is preferred to introduce a carboxyl group to the surface of the carbon black by the surface modification treatment with a radical generating agent having a carboxyl group. The treatment with an acid or an oxidant causes side reaction of functional groups other than a carboxyl group, such as a carbonyl group, and it may be difficult to achieve the desired carboxyl group density.

In the preparation method of a toner for developing an electrostatic image according to an exemplary embodiment described later, it is preferred to introduce a carboxyl group to the surface of the carbon black by the surface modification treatment with a radical generating agent having a carboxyl group.

The radical generating agent having a carboxyl group may be an azo radical generating agent having a carboxyl group. Specific examples thereof include 2,2'-azobis(N-(2-carboxyethyl)-2-methylpropoionamidine) and a compound represented by the following formula (1):

(1)

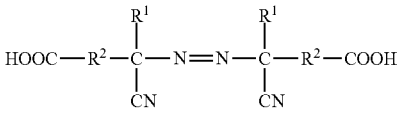

wherein $R^1$ represents an alkyl group having from 1 to 4 carbon atoms, and $R^2$ represents an alkylene group having from 1 to 6 carbon atoms.

In the formula (1), $R^1$ may be a linear alkyl group or a branched alkyl group. $R^1$ is preferably an alkyl group having from 1 to 3 carbon atoms, and more preferably a methyl group.

In the formula (1), $R^2$ may be a linear alkylene group or a branched alkylene group or an alkylene group having a cyclic structure. $R^2$ is preferably an alkylene group having from 1 to 4 carbon atoms, more preferably an alkylene group having 2 or 3 carbon atoms, and particularly preferably an ethylene group.

Among these, the compound represented by the formula (1) is particularly preferably 4,4'-azobis(4-cyanopentanoic acid).

The compound represented by the formula (1) generates a radical through decomposition with heat as shown below. The radical thus generated is reacted on the surface of the carbon black, thereby modifying the surface of the carbon black.

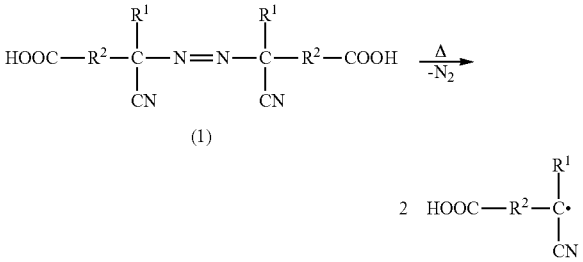

The temperature, on which the surface modification treatment is performed with the radical generating agent having a carboxyl group may be appropriately selected depending on the structure of the compound represented by the formula (1), the reaction conditions, the intended modification amount and the like, and may be, for example, from approximately 40° C. to approximately 200° C.

The solvent used in the surface modification treatment with the radical generating agent having a carboxyl group is not particularly limited, and may be appropriately selected in consideration of the boiling point, the stability and the solubility of the radical generating agent having a carboxyl group, and the like. The solvent may be methyl ethyl ketone from the standpoint of the post-treatment.

The ratio of the carbon black and the radical generating agent having a carboxyl group used is not particularly limited, and may be determined depending on the intended introduction amount of carboxyl groups to the surface of the carbon black. The surface modification treatment with the radical generating agent having a carboxyl group may be employed since the amount of carboxyl groups introduced is easily controlled as compared to an ordinary surface treatment, and a carboxyl group may be introduced directly to the surface.

The carbon black used in the exemplary embodiment may have on the surface thereof a group represented by the following formula (2) from the standpoint of the dispersibility of the carbon black in an aqueous medium and the transferring property of the toner under a high temperature and high humidity environment.

(2)

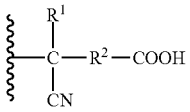

wherein $R^1$ represents an alkyl group having from 1 to 4 carbon atoms, $R^2$ represents an alkylene group having from 1 to 6 carbon atoms, and the wavy line shows the bond to the surface of the carbon black.

In the formula (2), $R^1$ and $R^2$ have the same meanings as $R^1$ and $R^2$ in the formula (1), respectively, and the preferred embodiments thereof are also the same.

The amount of the carbon black having a surface carboxyl group density of from approximately $2\times10^{-6}$ mol/m$^2$ to approximately $8\times10^{-6}$ mol/m$^2$ used on the surface of the toner of the exemplary embodiment may be from 0.1 part by weight or approximately 0.1 part by weight to 20 parts by weight or approximately 20 parts by weight, and preferably from approximately 0.5 part by weight to approximately 10 parts by weight, per 100 parts by weight of the toner.

The toner of the exemplary embodiment may contain one kind of the carbon black having a surface carboxyl group density of from approximately $2\times10^{-6}$ mol/m$^2$ to approximately $8\times10^{-6}$ mol/m$^2$ solely or may contain two or more kinds thereof in combination.

Binder Resin

The toner for developing an electrostatic image according to the exemplary embodiment contains a binder resin having an acid value of from approximately 10 mgKOH/g to approximately 20 mgKOH/g (which may be hereinafter referred simply to a binder resin).

The acid value of the binder resin used in the exemplary embodiment is from 10 mgKOH/g or approximately 10 mgKOH/g to 20 mgKOH/g or approximately 20 mgKOH/g, preferably from approximately 11 mgKOH/g to approximately 18 mgKOH/g, and more preferably from 12 mgKOH/g or approximately 12 mgKOH/g to 15 mgKOH/g or approximately 15 mgKOH/g. When the acid value is in the range, the toner is excellent in charging property.

The toner for developing an electrostatic image of the exemplary embodiment may contain the binder resin solely or may contain two or more kinds thereof in combination. The acid value of the binder resin in the exemplary embodiment is an acid value that is obtained by measuring the total components of the binder resin contained in the toner.

The acid value of the binder resin in the exemplary embodiment may be measured in such a manner that a sample is dissolved in a solvent, to which an acid is added to make pH of 2 or less, and the acid value is measured by a known method according to JIS K0070. The acid value referred in the exemplary embodiment is a value in terms of milligram of potassium hydroxide that is necessary for neutralizing resin acid, a free fatty acid and the like contained in 1 g of the sample.

Examples of the binder resin include a homopolymer and a copolymer of a styrene compound, such as styrene and chlorostyrene, a monoolefin, such as ethylene, propylene, butylene and isoprene, a vinyl ester, such as vinyl acetate, vinyl propionate, vinyl benzoate and vinyl acetate, an α-methylene aliphatic monocarboxylate ester, such as methyl acrylate, ethyl acrylate, butyl acrylate, dodecyl acrylate, octyl acrylate, phenyl acrylate, methyl methacrylate, ethyl methacrylate, butyl methacrylate and dodecyl methacrylate, a vinyl ether, such as vinyl methyl ether, vinyl ethyl ether and vinyl butyl ether, and a vinyl ketone, such as vinyl methyl ketone, vinyl hexyl ketone and vinyl isopropenyl ketone.

Representative examples of the binder resin include polystyrene, a styrene-alkyl acrylate copolymer, a styrene-alkyl methacrylate copolymer, a styrene-acrylonitrile copolymer, a styrene-butadiene copolymer, a styrene-maleic anhydride copolymer, polyethylene and polypropylene. Examples thereof further include a polyester resin, a polyurethane resin, an epoxy resin, a silicone resin, a polyamide resin, modified rosin, paraffin and wax. The binder resin may contain a polyester resin among these, and preferably contains a polyester resin in an amount of approximately 50% by weight or more, more preferably approximately 80% by weight or more, and particularly preferably approximately 90% by weight or more, based on the total amount of the binder resin.

The polyester resin used in the exemplary embodiment may be synthesized, for example, from a polyol component and a polycarboxylic acid component through polycondensation. In the exemplary embodiment, a commercially available product may be used as the polyester resin, or a polyester resin that is appropriately synthesized may be used therefor.

Examples of the polyvalent carboxylic acid component include an aliphatic dicarboxylic acid, such as oxalic acid, succinic acid, glutaric acid, adipic acid, suberic acid, azelaic acid, sebacic acid, 1,9-nonanedicarboxylic acid, 1,10-decanedicarboxylic acid, 1,12-dodecanedicarboxylic acid, 1,14-tetradecanedicarboxylic acid and 1,18-octadecanedicarboxylic acid, and an aromatic dicarboxylic acid, such as dibasic acids including phthalic acid, isophthalic acid, terephthalic acid, naphthalene-2,6-dicarboxylic acid, malonic acid and mesaconic acid. Examples thereof further include anhydrides and lower alkyl esters thereof. The polyvalent carboxylic acid component is not limited to the examples.

Examples of a trivalent or higher valent carboxylic acid include 1,2,4-benzenetricarboxylic acid, 1,2,5-benzenetricarboxylic acid, 1,2,4-naphthalenetricarboxylic acid, and anhydrides and lower alkyl esters thereof. The polyvalent carboxylic acid component may be used solely or as a combination of two or more kinds thereof.

In addition to the aliphatic dicarboxylic acid and the aromatic dicarboxylic acid mentioned above, a dicarboxylic acid component having an ethylenic unsaturated double bond may be used. The dicarboxylic acid component having an ethylenic unsaturated double bond may form radically a crosslinking bond through the ethylenic unsaturated double bond, thereby preventing hot offset upon fixing. Examples of the dicarboxylic acid include maleic acid, fumaric acid, 3-hexenedioic acid and 3-octenedioic acid, but the dicarboxylic acid is not limited to the examples. Examples thereof further include anhydrides and lower alkyl esters thereof. Preferred examples thereof among these include fumaric acid and maleic acid, from the standpoint of cost.

Examples of the polyol component include, as a divalent alcohol, an alkylene oxide (having from 2 to 4 carbon atoms) adduct of bisphenol A (average addition molar number: 1.5 to 6), such as polyoxypropylene (2.2)-2,2-bis(4-hydroxyphenyl)propane and polyoxyethylene (2.2)-2,2-bis(4-hydroxyphenyl)propane, ethylene glycol, propylene glycol, neopentyl glycol, 1,4-butanediol, 1,3-butanediol and 1,6-hexanediol.

Examples thereof, as a trivalent or higher alcohol, include sorbitol, pentaerythritol, glycerol and trimethylolpropane.

Preferred examples of the divalent or higher aromatic carboxylic acid include terephthalic acid, isophthalic acid, phthalic acid and trimellitic acid, and terephthalic acid and trimellitic acid are more preferred.

The toner for developing an electrostatic image of the exemplary embodiment may contain a crystalline polyester resin as a binder resin. The crystalline polyester resin contained enhances the viscosity change on temperature of the binder resin, and thus the field of molecular motion per unit volume of the toner is enhanced to prevent the toner being expanded, thereby preventing paper from getting cockled.

The term "crystalline" of the crystalline polyester resin herein means that the resin exhibits a clear endothermic peak in the measurement with a differential scanning calorimeter (DSC), but not a stepwise change of endothermic amount. The term "amorphous" of the amorphous polyester resin herein means that the resin exhibits only a stepwise change of endothermic amount in the measurement with a differential scanning calorimeter (DSC), but not a clear endothermic peak exhibited.

The crystalline polyester resin may have a melting point of from approximately 45° C. to approximately 95° C., and preferably from approximately 50° C. to approximately 85° C. The melting point of the crystalline polyester resin may be measured with a differential scanning calorimeter (DSC), and the peak value of the endothermic peak obtained in the measurement of from 20° C. to 120° C. at a temperature increasing rate of 10° C. per minute may be designated as the melting point.

Examples of the polyol component used in the preparation of the crystalline polyester resin include a diol compound, such as a glycol compound, e.g., as ethylene glycol, propylene glycol, 1,4-butanediol, 2,3-butanediol, 1,5-pentanediol, 1,6-hexanediol, neopentyl glycol, 1,4-cyclohexanedimethanol, dipropylene glycol and tripropylene glycol, bisphenol A and a derivative and an alkylene oxide adduct thereof, and a hydrogenated bisphenol A, and a triol or higher compound, such as glycerin, sorbitol, 1,4-sorbitan and trimethylolpropane.

Examples of the polycarboxylic acid compound used in the preparation of the crystalline polyester resin include malonic acid, succinic acid, 1,2,5-hexanetricarboxylic acid, 1,2,7,8-octanetetracarboxylic acid, n-octylsuccinic acid, 1,3-dicarboxy-2-methyl-2-carboxymethylpropane, tetra(carboxydimethyl)methane, maleic acid, fumaric acid, dodecenylsuccinic acid, 1,2,4-cyclohexanetricarboxylic acid, phthalic acid, isophthalic acid, terephthalic acid, trimellitic acid, pyromellitic acid and 1,2,4-naphthalenetricarboxylic acid.

In the polyvalent carboxylic acid component, the content of an aliphatic dicarboxylic acid may be approximately 80% by mol or more, and preferably approximately 90% by mol or more. When the content of an aliphatic dicarboxylic acid is approximately 80% by mol or more, the polyester resin has excellent crystallinity and a suitable melting point, and thus is excellent in the toner blocking property, the image storage stability and the low temperature fixing property.

In the polyol component, the content of an aliphatic dihydric diol component may be approximately 80% by mol or more, and preferably approximately 90% by mol or more. When the content of an aliphatic dihydric diol component is approximately 80% by mol or more, the polyester resin has excellent crystallinity and a suitable melting point, and thus is excellent in the toner blocking property, the image storage stability and the low temperature fixing property.

A monovalent acid, such as acetic acid and benzoic acid, and a monovalent alcohol, such as cyclohexanol and benzyl alcohol, may be used depending on necessity for controlling the acid value and the hydroxyl value.

The preparation method of the polyester resin is not particularly limited, and the polyester resin may be prepared by an ordinary polyester polymerization method where an acid component and an alcohol component are reacted with each other. Examples of the method include a direct polycondensation method and an ester exchanging method, which may be selected depending on the kind of the monomers.

The polyester resin may be prepared by subjecting the polyol and the polyvalent carboxylic acid to condensation reaction in an ordinary method. For example, the polyol, the polyvalent carboxylic acid and a catalyst depending on necessity are mixed in a reaction vessel equipped with a thermometer, a stirrer and a falling condenser, and are heated to a temperature of from 150° C. to 250° C. in the presence of an inert gas (such as nitrogen gas) while removing low molecular weight compounds by-produced to the exterior of the reaction system. After the acid value reached the prescribed value, the reaction is terminated, the reaction mixture is cooled, and the target reaction product is collected.

A polycondensation catalyst may be used in the polycondensation of the polyester resin.

Examples of the polycondensation catalyst include a sulfur acid catalyst, a Bronsted acid catalyst other than a sulfur acid catalyst, a metal catalyst, a hydrolase catalyst and a basic catalyst. Among these, a sulfur-acid catalyst is preferred.

Examples of the sulfur acid catalyst include an inorganic sulfur acid compound, such as sulfuric acid, sulfurous acid and salts thereof, and an organic sulfur acid compound, such as an alkylsulfonic acid, an arylsulfonic acid and salts thereof, and an alkylsulfuric acid, an arylsulfuric acid and salts thereof.

Specific examples thereof include an alkylbenzenesulfonic acid, such as dodecylbenzenesulfonic acid, isopropylbenzenesulfonic acid and camphor sulfonic acid, an alkylsulfonic acid, an alkyldisulfonic acid, an alkylphenolsulfonic acid, an alkylnaphthalenesulfonic acid, an alkyltetralinesulfonic acid, an alkylallylsulfonic acid, a petroleum sulfonic acid, an alkylbenzoimidazolesulfonic acid, a higher alcohol ether sulfonic acid, an alkyldiphenylsulfonic acid, monobutylphenylphenolsulfuric acid, dibutylphenylphenolsulfuric acid, a higher aliphatic sulfate ester, such as a dodecyl sulfate ester, a higher alcohol sulfate ester, a higher alcohol ether sulfate ester, a higher fatty acid amide alkylol sulfate ester, a higher fatty acid amide alkylated sulfate ester, naphthenyl alcohol sulfate, sulfated fat, a sulfosuccinate ester, a sulfonated higher fatty acid, resin acid alcohol sulfate, and salt compounds of all these compounds, but the sulfur acid catalyst is not limited to the examples. The catalyst may have a functional group in the structure thereof. The catalysts may be used in combination of plural kinds thereof. Examples of the Bronsted acid catalyst containing sulfur include an alkylbenzenesulfonic acid, and preferred examples thereof include dodecylbenzenesulfonic acid, benzenesulfonic acid, p-toluenesulfonic acid and camphor sulfonic acid.

The total amount of the polycondensation catalyst added may be from approximately 0.01 to approximately 10% by weight, and preferably from approximately 0.01 to approximately 8% by weight, based on the polycondensation components.

The polycondensation catalyst may be used solely or as a combination of two or more kinds thereof.

In the toner for developing an electrostatic image of the exemplary embodiment, the content of the binder resin may be from approximately 10 to approximately 90% by weight, preferably from approximately 30 to approximately 85% by weight, and more preferably from approximately 50 to approximately 80% by weight, based on the total weight of the toner for developing an electrostatic image.

Releasing Agent

The toner for developing an electrostatic image of the exemplary embodiment may contain a releasing agent.

Specific examples of the releasing agent used in the exemplary embodiment include various kinds of ester wax, a low molecular weight polyolefin, such as polyethylene, polypropylene and polybutene, a silicone compound that exhibits a softening point upon heating, a fatty acid amide, such as oleic acid amide, erucic acid amide, ricinoleic acid amide and stearic acid amide, vegetable wax, such as carnauba wax, rice wax, candelilla wax, wood wax and jojoba oil, animal wax, such as beeswax, mineral or petroleum wax, such as montan wax, ozokerite, ceresin, paraffin wax, microcrystalline wax and Fischer-Tropsch wax, and modified products of these compounds.

These kinds of wax are substantially not dissolved in a solvent, such as toluene, or are dissolved therein in an only slight amount, around room temperature (25° C.).

The wax may be dispersed in water along with an ionic surfactant or a polymer electrolyte, such as a polymer acid and a polymer base, and dispersed to particles under heating to a temperature equal to or higher than the melting point thereof with a homogenizer or a pressure discharge dispersing device (Gaulin Homogenizer, available from Gaulin), thereby preparing a dispersion containing particles of 1 μm or less.

The releasing agent may be added in an amount of from approximately 5 to approximately 25% by weight based on the total weight of the solid contents constituting the toner for ensuring the releasing property of a fixed image in an oil-less fixing system.

The particle size of the obtained releasing agent particle dispersion may be measured, for example, with a laser diffraction particle size analyzer (LA-920, available from Horiba, Ltd.). Upon using the releasing agent, the resin particle dispersion may be further added after aggregating the colorant particles and the releasing agent particles, thereby attaching the resin particles to the aggregated particles, for ensuring the charging property and the lifetime.

In the toner for developing an electrostatic image of the exemplary embodiment, the releasing agent may be selected appropriately from the standpoint of the fixing property, the toner blocking property, the toner strength and the like.

The content of the releasing agent in the toner for developing an electrostatic image of the exemplary embodiment is not particularly limited and may be from approximately 2 to approximately 20 parts by weight per 100 parts by weight of the binder resin contained in the toner.

Other Additives

The toner for developing an electrostatic image of the exemplary embodiment may contain, in addition to the components described above, various components, such as an internal additive, a charge controlling agent, inorganic powder (inorganic particles) and organic particles, depending on necessity.

Examples of the internal additive include a magnetic material, such as a metal and an alloy, e.g., ferrite, magnetite, reduced iron, cobalt, nickel and manganese, and compounds containing the metals.

Examples of the charge controlling agent include a quaternary ammonium compound, a nigrosine compound, a dye containing a complex of aluminum, iron, chromium or the like, and a triphenylmethane pigment.

The inorganic powder may be added to the toner mother particles for controlling the viscoelasticity of the toner, and examples thereof include any kind of inorganic particles that are generally used as an external additive added to a surface of a toner, for example, silica, alumina, titanic, calcium carbonate, magnesium carbonate, calcium phosphate and cerium oxide, described in detail later.

The toner for developing an electrostatic image of the exemplary embodiment may contain a colorant other than the carbon black having a surface carboxyl group density of from approximately $2\times10^{-6}$ mol/m$^2$ to approximately $8\times10^{-6}$ mol/m$^2$, i.e., the other colorant, depending on necessity, and carbon black that is contained in the toner may be only the carbon black having a surface carboxyl group density of from approximately $2\times10^{-6}$ mol/m$^2$ to approximately $8\times10^{-6}$ mol/m$^2$.

The content of the other colorant in the toner for developing an electrostatic image of the exemplary embodiment may be smaller than the content of the carbon black having a surface carboxyl group density of from approximately $2\times10^{-6}$ mol/m$^2$ to approximately $8\times10^{-6}$ mol/m$^2$.

Examples of the other colorant used in the exemplary embodiment include the following materials.

Examples of a black pigment include copper oxide, manganese dioxide, Aniline Black, activated carbon, non-magnetic ferrite and magnetite.

Examples of a yellow pigment include Chrome Yellow, Zinc Yellow, Yellow Iron Oxide, Cadmium Yellow, Chrome Yellow, Hansa Yellow, Hansa Yellow 10G, Benzidine Yellow G, Benzidine Yellow GR, Indanthrene Yellow, Quinoline Yellow and Permanent Yellow NCG.

Examples of an orange pigment include Red Chrome Yellow, Molybdenum Orange, Permanent Orange GTR, Pyrazolone Orange, Vulkan Orange, Benzidine Orange G, Indanthrene Brilliant Orange RK and Indanthrene Brilliant Orange GK.

Examples of a red pigment include Red Iron Oxide, Cadmium Red, Red Lead Oxide, mercury sulfide, Watchyoung Red, Permanent Red 4R, Lithol Red, Brilliant Carmine 3B, Brilliant Carmine 6B, Du Pont Oil Red, Pyrazolone Red, Rhodamine B Lake, Lake Red C, Rose Bengal, Eosin Red and Alizarin Lake.

Examples of a blue pigment include Iron Blue, Cobalt Blue, Alkali Blue Lake, Victora Blue Lake, Fast Sky Blue, Indanthrene Blue BC, Aniline Blue, Ultramarine Blue, Calco Oil Blue, Methylene Blue Chloride, Phthalocyanine Blue, Phthalocyanine Green and Malachite Green Oxalate.

Examples of a violet pigment include Manganese Violet, Fast Violet B and Methyl Violet Lake.

Examples of a green pigment include chromium oxide, Chromium Green, Pigment Green, Malachite Green Lake and Final Yellow Green G.

Examples of a white pigment include zinc flower, titanium oxide, Antimony White and zinc sulfide.

Examples of a body pigment include barite powder, barium carbonate, clay, silica, white carbon, talc and alumina white.

Examples of a dye include various materials including basic, acidic, dispersed and direct dyes, for example, nigrosine, Methylene Blue, Rose Bengal, Quinoline Yellow and Ultramarine Blue.

The median size of the other colorant particles may be from approximately 100 nm to approximately 330 nm. The median size of the colorant particles may be measured, for example, with a laser diffraction particle size analyzer (LA-920, available from Horiba, Ltd.).

The toner for developing an electrostatic image of the exemplary embodiment may have a volume average particle size of from approximately 2 μm to approximately 9 μm, and preferably from approximately 3 μm to approximately 7 μm. When the volume average particle size is in the range, the charging property, the developing property and the resolution of the image may be improved as compared to the case where the volume average particle sizer is outside the range.

The toner for developing an electrostatic latent image of the exemplary embodiment may have a volume average particle size distribution index GSDv of approximately 1.30 or less. When the volume average particle size distribution index GSDv is approximately 1.30 or less, the resolution of the image is improved.

In the exemplary embodiment, the particle size and the volume average particle size distribution index GSDv of the toner may be measured and calculated in the following manner. The particle size distribution of the toner particles measured with Multisizer II (available from Beckman Coulter, Inc.) is divided into particle size ranges (channels), in each of which an accumulated distribution of the volume of the toner particles is drawn from the small particle size side. The particle size at an accumulation of 16% is designated as the volume particle size $D_{16v}$, the particle size at an accumulation of 50% is designated as the volume average particle size $D_{50v}$, and the particle size at an accumulation of 84% is designated as the volume particle size $D_{84v}$. The volume average particle size distribution index GSDv is defined as $(D_{84v}/D_{16v})^{1/2}$ and is calculated from the expression.

The toner for developing an electrostatic latent image of the exemplary embodiment may have a shape factor SF1 (=((absolute maximum length of toner size)$^2$/projected area of toner)×(π/4)×100) in a range of from approximately 110 to approximately 160, and preferably in a range of from approximately 125 to approximately 140.

The value of shape factor SF1 is an index showing the roundness of the toner, and is 100 for a true sphere and is increased when the shape of the toner becomes irregular. The values that are necessary for calculating the shape factor SF1, i.e., the absolute maximum length of the toner size and the projected area of the toner, may be calculated from data obtained in the following manner. Image information of toner particle images is obtained with an optical microscope (Microphoto-FXA, available from Nikon Corporation) in a magnitude of 500 and is introduced to, for example, an image analyzer (Luzex III, available from Nireco Corporation) through an interface and analyzed thereby. The average value of the shape factor SF1 is calculated from data obtained by measuring 1,000 toner particles sampled at random.

When the shape factor SF1 is approximately 110 or more, the toner is suppressed from remaining on transferring for forming an image, which provides good cleaning property on cleaning with a blade or the like, and thus image defects are suppressed from occurring. When the shape factor SF1 is approximately 160 or less, the toner used as a developer is prevented from being broken due to impact with a carrier in a developing device, and thus fine powder is prevented from being formed. Accordingly, the surface of the photoconductor or the like is prevented from being contaminated with the releasing agent component exposed to the surface of the toner, and thus not only the charging property is enhanced, but also fogging or the like caused by the fine powder may be prevented from occurring.

Preparation Method of Toner for Developing Electrostatic Image

The toner for developing an electrostatic image of the exemplary embodiment may be prepared by any method, and may be prepared in the method described below.

Aggregation and Coalescence Method

The preparation method of the toner for developing an electrostatic image according to the exemplary embodiment (which may be hereinafter referred simply to as a preparation method of a toner) may contain: preparing an aqueous dispersion containing resin particles having an acid value of from approximately 10 mgKOH/g to approximately 20 mgKOH/g and carbon black having a surface carboxyl group density of from approximately $2\times10^{-6}$ mol/m$^2$ to approximately $8\times10^{-6}$ mol/m$^2$; aggregating the resin particles and the carbon black, thereby providing aggregated particles, in the aqueous dispersion; and coalescing the aggregated particles by heating.

In the preparation method of the toner for developing an electrostatic image of the exemplary embodiment, a releasing agent particle dispersion and the like may be added to the aqueous dispersion containing the resin particles having an acid value of from approximately 10 mgKOH/g to approximately 20 mgKOH/g and the carbon black having a surface carboxyl group density of from approximately $2\times10^{-6}$ mol/m$^2$ to approximately $8\times10^{-6}$ mol/m$^2$.

In the preparation method of the toner for developing an electrostatic image of the exemplary embodiment, the resin particles and the carbon black, and also the other particles added, are aggregated (i.e., are get attached to each other) by a known aggregating method, thereby controlling the particle size and the particle size distribution of the toner particles. More specifically, a dispersion of the resin particles and a dispersion of the carbon black are mixed with a dispersion of the releasing agent particles and the like, to which an aggregating agent is added to form aggregated particles having the toner size through hetero aggregation, and then the aggregated particles are heated to a temperature equal to or higher than the glass transition temperature or the melting point of the resin particles to coalesce the aggregated particles, followed by rinsing and drying, thereby providing the toner particles. The preparation method may control the toner shape from an irregular shape to a spherical shape by selecting the temperature conditions.

Preparation of Dispersion

The preparation method of the toner for developing an electrostatic image of the exemplary embodiment may contain preparation of an aqueous dispersion containing the resin particles having an acid value of from 10 mgKOH/g or approximately 10 mgKOH/g to 20 mgKOH/g or approximately 20 mgKOH/g and the carbon black having a surface carboxyl group density of from $2\times10^{-6}$ mol/m$^2$ or approximately $2\times10^{-6}$ mol/m$^2$ to $8\times10^{-6}$ mol/m$^2$ or approximately $8\times10^{-6}$ mol/m$^2$.

The preparation method of the aqueous dispersion containing the resin particles and the carbon black is not particularly limited, and for example, an aqueous dispersion of the resin particles and an aqueous dispersion of the carbon black may be prepared separately and then mixed, thereby preparing the target aqueous dispersion, or in alternative, one of the resin particles and the carbon black may be dispersed in an aqueous dispersion of the other of them, thereby preparing the target aqueous dispersion. It may be preferred that an aqueous dispersion of the resin particles and an aqueous dispersion of the carbon black are prepared separately and then mixed, thereby preparing the target aqueous dispersion, but the preparation method is not limited thereto.

In the preparation method of the toner for developing an electrostatic image of the exemplary embodiment, the surface carboxyl group density of the carbon black may be from approximately 65% to approximately 270%, preferably from approximately 100% to approximately 240%, and more preferably from approximately 150% to approximately 200%, based on the surface carboxyl group density of the resin particles as 100%. When the carboxyl group density is in the range, good mixing property of the resin particles and the carbon black may be obtained, thereby enhancing the transferring property of the toner under a high temperature and high humidity environment.

The surface carboxyl group densities of the carbon black and the resin particles may be measured by the method described above.

For providing the resin particle dispersion and the carbon black dispersion, the binder resin or the carbon black may be dispersed in an aqueous medium in any method, examples of which include emulsification and dispersion with a mechanical shearing force, ultrasonic wave or the like.

The resin particle dispersion and the carbon black dispersion each may contain an additive, such as a surfactant, a polymer dispersant and an inorganic dispersant, and a surfactant, a polymer dispersant, an inorganic dispersant and the like may be added upon performing the emulsification or dispersion.

Examples of the aqueous medium in the exemplary embodiment include water, such as distilled water and ion exchanged water, and an alcohol, such as ethanol and methanol. Among these, ethanol and water are preferred, water, such as pure water, deionized water and distilled water, is more preferred, and pure water and deionized water are particularly preferred. These aqueous media may be used solely or as a combination of two or more kinds thereof.

The aqueous medium may contain a water-miscible organic solvent. Examples of the water-miscible organic solvent include acetone and acetic acid.

Examples of the surfactant used in the exemplary embodiment include an anionic surfactant, such as a sulfate ester or salt surfactant, a sulfonate salt surfactant and a phosphate ester surfactant, a cationic surfactant, such as an amine salt surfactant and a quaternary ammonium salt surfactant, and a nonionic surfactant, such as a polyethylene glycol surfactant, an alkylphenol ethylene oxide adduct surfactant and a polyhydric alcohol surfactant. Among these, an anionic surfactant and a cationic surfactant are preferred.

The surfactants may be used solely or as a combination of two or more kinds thereof. The nonionic surfactant may be used in combination with the anionic surfactant or the cationic surfactant.

Examples of the anionic surfactant include sodium dodecylbenzenesulfonate, sodium alkylnaphthalenesulfonate, sodium arylalkylpolyethersulfonate, sodium 3,3'-disulfonediphenylurea-4,4'-diazobisamino-8-naphthol-6-sulfonate, o-carboxybenzene-azo-dimethylaniline, sodium 2,2',5,5'-tetramethyltriphenylmethane-4,4'-diazobis-β-naphthol-6-sulfonate, sodium dialkylsulfosuccinate, sodium dodecylsulfate, sodium tetradecylsulfate, sodium pentadecylsulfonate, sodium octylsulfonate, sodium oleate, sodium laurate, sodium caprate, sodium caprylate, sodium caproate, potassium stearate and calcium oleate.

Examples of the cationic surfactant include alkylbenzenedimethylammonium chloride, alkyltrimethylammonium chloride and distearylammonium chloride.

Examples of the nonionic surfactant include polyethylene oxide, polypropylene oxide, a combination of polypropylene oxide and polyethylene oxide, an ester of polyethylene glycol and a higher fatty acid, alkylphenolpolyethylene oxide, an ester of a higher fatty acid and polyethylene glycol, an ester of a higher fatty acid and polypropylene oxide, and sorbitan ester.

Examples of the polymer dispersant include sodium polycarboxylate and polyvinyl alcohol, and examples of the inorganic dispersant include calcium carbonate, but the exemplary embodiment is not limited to the examples.

For preventing the Ostwald ripening of the monomer emulsion particles in the aqueous medium, a higher alcohol, such as heptanol and octanol, or a higher aliphatic hydrocarbon, such as hexadecane, may be added as an assistant stabilizer.

Aggregation

The preparation method of the toner for developing an electrostatic image of the exemplary embodiment may contain aggregation of the resin particles and the carbon black, thereby providing aggregated particles, in the aqueous dispersion.

In the aggregation, aggregated particles containing the particles of the respective components aggregated therewith may be formed by adding an aggregating agent to the aqueous dispersion under heating to, for example, a temperature that is slightly lower than the melting point or the glass transition temperature of the resin particles. The aqueous dispersion may be heated to a temperature equal to or higher than the glass transition temperature, whereby coalescence is performed simultaneously with the aggregation, thereby forming coalesced particles.

The aggregated particles may be formed by adding an aggregating agent under stirring with a rotation shearing homogenizer at a temperature of from 20° C. to 60° C. Examples of the aggregating agent used in the aggregation include a surfactant having a polarity opposite to the surfactant used as the dispersant for the dispersions, an inorganic metal salt, and a divalent or higher metal complex.

In the case where the metal complex may be used, the amount of the surfactant used may be decreased, thereby enhancing the charging property.

Examples of the aggregating agent include a compound having monovalent or higher charge, and specific examples of the compound include the water soluble surfactants including the ionic surfactants and the nonionic surfactants described above, an acid, such as hydrochloric acid, sulfuric acid, nitric acid, acetic acid and oxalic acid, a metal salt of an inorganic acid, such as magnesium chloride, sodium chloride, aluminum chloride (including polyaluminum chloride), aluminum sulfate, calcium sulfate, ammonium sulfate, aluminum nitrate, silver nitrate, copper sulfate and sodium carbonate, a metal salt of an aliphatic acid or an aromatic acid, such as sodium acetate, potassium formate, sodium oxalate, sodium phthalate and potassium salicylate, a metal salt of a phenol compound, such as sodium phenolate, a metal salt of an amino acid, and an inorganic acid salt of an aliphatic or aromatic amine, such as triethanolamine hydrochloride and aniline hydrochloride.

In consideration of the stability of the aggregated particles, the stability of the aggregating agent against heat and time-dependent, and removal of the aggregating agent upon rinsing, a metal salt of an inorganic acid may be used as the aggregating agent from the standpoint of performance and use. Specific examples of the metal salt of an inorganic acid include magnesium chloride, sodium chloride, aluminum chloride (including polyaluminum chloride), aluminum sulfate, ammonium sulfate, aluminum nitrate, silver nitrate, copper sulfate and sodium carbonate.

The amount of the aggregating agent added may vary depending on the valency and may be a small amount, which may be approximately 3% by weight or less for a monovalent compound, approximately 1% by weight or less for a divalent compound, and approximately 0.5% by weight of less for a trivalent compound, all based on the total amount of the toner. The amount of the aggregating agent may be as small as possible, and a compound having a larger valency may be used.

Coalescence

The preparation method of the toner for developing an electrostatic image of the exemplary embodiment may contain coalescence of the aggregated particles by heating.

The coalescence may be performed at a temperature equal to or higher than the glass transition temperature of the resin having the higher glass transition temperature among the binder resins in the aggregated particles. The period of time for the coalescence may be shorter when the heating temperature is higher, and may be longer when the heating temperature is lower. Thus, the period of time for the coalescence may not be determined unconditionally since it may vary depending on the heating time, and may be from approximately 30 minutes to approximately 10 hours.

Solid-Liquid Separation, Rinsing and Drying

The preparation method of the toner for developing an electrostatic image of the exemplary embodiment may further contain, after the coalescence, solid-liquid separation for separating the toner obtained by the coalescence from the aqueous medium, rinsing the obtained toner, and/or drying the obtained toner.

The aggregated particles obtained through the coalescence may be subjected to the solid-liquid separation, such as filtering, rinsing and drying. A toner having no external additive added (i.e., toner mother particles) is obtained accordingly.

The solid-liquid separation is not particularly limited, and suction filtration, pressure filtration and the like may be employed from the standpoint of productivity. The rinsing may be performed by substitution rinsing with ion exchanged water from the standpoint of charging property.

The drying may be performed by an arbitrary method, such as a vibration fluidized drying method, a spray drying method, a freeze drying method and a flash jet method. The toner particles may be controlled to have a water content after drying of approximately 1.0% by weight or less, and preferably 0.5% by weight or less.

External Addition

The preparation method of the toner for developing an electrostatic image of the exemplary embodiment may further contain external addition of adding an external additive to the obtained toner.

The method of externally adding inorganic particles, such as silica and titania, to the surface of the toner mother particles is not particularly limited and may be any known method, examples of which include method of attaching the external additive to the surface of the toner mother particles by a mechanical method or a chemical method.

Dissolution and Suspension Method

The toner for developing an electrostatic image of the exemplary embodiment may be prepared by a dissolution and suspension method instead of the aggregation and coalescence method.

The dissolution and suspension method may contain: preparing an oily phase by dissolving or dispersing at least a binder resin and a toner component including a colorant, in an organic solvent; granulating by suspending the oily phase in an aqueous phase; and removing the solvent.

In the dissolution and suspension method, at least a binder resin and a toner component including a colorant are dissolved or dispersed in an organic solvent, thereby preparing an oily phase. Examples of the organic solvent that may be used herein include, while depending on the kind of the binder resin, a hydrocarbon, such as toluene, xylene and hexane, a halogenated hydrocarbon, such as methylene chloride, chloroform and dichloroethane, an alcohol or an ether, such as ethanol, butanol, benzyl alcohol ether and tetrahydrofuran, an ester, such as methyl acetate, ethyl acetate, butyl acetate and isopropyl acetate, and a ketone, such as acetone, methyl ethyl ketone, diisobutyl ketone, cyclohexanone and methylcyclohexanone. The solvent dissolves the binder resin but may not dissolve the colorant and other additives. The weight ratio of the binder resin and the toner component including the colorant to the solvent may be from approximately 10/90 to approximately 80/20 from the standpoint of the facility in granulation and the final yield of the toner.

In the exemplary embodiment, before preparing the oily phase, a colorant dispersion may be prepared in advance by dispersing the colorant with a synergist and a dispersant. Upon preparing the colorant dispersion, the synergist and the dispersant are attached to the colorant. The attaching operation may be performed by using an ordinary agitation device. Specifically, the colorant, the synergist and the dispersant are placed in a suitable agitation device with granular media, such as an attritor, a ball mill, a sand mill or a vibration mill, and are agitated while maintaining the agitation device at a suitable temperature range, for example, in a range of from approximately 20° C. to approximately 160° C. Example of the granular media include steel, such as stainless steel and carbon steel, alumina, zirconia and silica. The agitation device dissociates aggregation of the colorant, disperses the colorant to an average particle size of approximately 0.5 μm or less, and preferably approximately 0.3 μm or less, and attaches the synergist and the dispersant to the colorant by applying the agitation load. The colorant having the synergist and the dispersant attached is then diluted with a solvent to prepare the colorant dispersion.

In the exemplary embodiment, the colorant dispersion may be again dispersed by high-speed shearing or the like for preventing the colorant from being aggregated before mixing with the binder resin and the like. The dispersion operation may be performed with a dispersing device having a high-speed shearing mechanism of a high-speed blade rotation type or a forced space passing type, such as a homomixer, a homogenizer, a colloid mill, Ultra-Turrax and Clear Mill. In the preparation of the oily phase, the colorant may be dispersed in the oily phase to approximately 1 μm or less, preferably approximately 0.5 μm or less, and more preferably approximately 0.3 μm or less.

The oily phase component is then suspended and granulated to have a prescribed particle size in an aqueous phase. The aqueous phase may contain water as a major component, to which an organic or inorganic dispersion stabilizer described later may be added depending on necessity. The dispersion stabilizer stabilizes the dispersion state of liquid droplets of the oily phase through formation of hydrophilic colloid. Examples of the inorganic dispersion stabilizer include calcium carbonate, magnesium carbonate, barium carbonate, tricalcium phosphate, hydroxyapatite, siliceous diatom earth and clay. The inorganic dispersion stabilizer may have a particle size of approximately 2 μm or less, preferably approximately 1 μm or less, and more preferably approximately 0.1 μm or less, and may be used after pulverizing to a prescribed particle size with a set dispersing device, such as a ball mill, a sand mill and an attritor. When the particle size of the inorganic dispersion stabilizer is approximately 2 μm or less, the toner thus granulated may favorably have a narrow particle size distribution.

Examples of the organic dispersion stabilizer, which may be used solely or in combination with the inorganic dispersion stabilizer, include a protein, such as gelatin, a gelatin derivative (e.g., acetylated gelatin, phthalated gelatin and succinylated gelatin), albumin and casein, collodion, gum arabic, agar, alginic acid, a cellulose derivative (e.g., an alkyl ester of carboxymethyl cellulose, hydroxymethyl cellulose and carboxymethyl cellulose), and a synthetic polymer (e.g., polyvinyl alcohol, polyvinylpyrrolidone, polyacrylamide, polyacrylic acid, polymethacrylic acid, polymaleic acid and polystyrenesulfonic acid). The organic dispersion stabilizer may be used solely or as a mixture of two or more kinds thereof. The dispersion stabilizer may be used in an amount in a range of from approximately 0.001% by weight to approximately 5% by weight based on the major medium of the aqueous phase.

The aqueous phase may contain a dispersion stabilization assistant. The dispersion stabilization assistant may be various kinds of surfactants. Examples of the surfactant include an ionic surfactant and a nonionic surfactant.

Examples of the anionic surfactant include an alkylbenzenesulfonate salt, an alkylphenylsulfonate salt, an alkylnaphthalenesulfonate salt, a higher fatty acid salt, a sulfate ester salt of a higher fatty acid ester, and a sulfonate salt of a higher fatty acid ester. Examples of the cationic surfactant include a primary to tertiary amine salt and a quaternary ammonium salt. Examples of the nonionic surfactant include polyoxyethylene nonyl phenyl ether, polyoxyethylene octyl phenyl ether, polyoxyethylene dodecyl phenyl ether, polyoxyethylene alkyl ether, polyoxyethylene fatty acid ester, sorbitan fatty acid ester, polyoxyethylene sorbitan fatty acid ester and fatty acid alkylolamide. The dispersion stabilization assistant may be used solely or as a mixture of two or more thereof. The dispersion stabilization assistant may be used in an amount in a range of from approximately 0.001% by weigh to approximately 5% by weight based on the major medium of the aqueous phase.

The oily phase and the aqueous phase may be generally mixed at a weight ratio of from approximately 10/90 to approximately 90/10 while the ratio varies depending on the particle size of the toner finally obtained, and the production equipments. The oily phase may be granulated in the aqueous phase under application of high-speed shearing force. In the case where the toner to be prepared has a particle size of from approximately 5 μm to approximately 9 μm, it is important to select properly the dispersion device having a high-speed shearing mechanism. In particular, an emulsion dispersion device of a high-speed blade rotation type or a forced space passing type, such as a homomixer, a homogenizer, a colloid mill, Ultra-Turrax and Clear Mill, may be used.

The solvent may be removed during the granulation or after completing the granulation. The solvent may be removed at ordinary temperature or may be removed under reduced pressure. For removing the solvent at ordinary temperature, such a temperature may be applied that is lower than the boiling point of the solvent and is selected in consideration of the glass transition temperature Tg of the resin. When the temperature exceeds largely the glass transition temperature Tg of the resin, unintended integration may occur. For example, the solvent may be removed at a temperature of from approximately 30° C. to approximately 50° C. for a period of from approximately 3 hours to approximately 24 hours under stirring. When the solvent is removed under reduced pressure, the pressure may be from approximately 20 mmHg to approximately 150 mmHg.

The obtained granulated product (slurry) may be rinsed with an acid that water-solubilizes the inorganic dispersion stabilizer, such as hydrochloric acid, nitric acid, formic acid and acetic acid, after removing the solvent. According to the operation, the inorganic dispersion stabilizer remaining on the surface of the toner is removed. A toner having the inorganic dispersion stabilizer or the organic dispersion stabilizer remaining on the surface thereof may be deteriorated in humidity dependency of the charging property of the toner due to the hygroscopic property of the attached matters remaining on the surface. The dispersion stabilizer remaining on the surface may be removed as much as possible, thereby avoiding the influence thereof on the charging property and the powder fluidity of the toner. The granulated product having been treated with an acid or an alkali may be further rinsed with an alkaline aqueous solution, such as sodium hydroxide, depending on necessity. According to the operation, a part of the ionic substance, which has been insolubilized under the acidic atmosphere, may be favorably solubilized and removed, thereby improving the charging property and the powder fluidity of the toner. The rinsing of the toner with an acidic or alkaline aqueous solution also removes the dissociated wax attached to the surface of the toner. The conditions including the pH on rinsing, the number of times of rinsing and the temperature on rinsing may be appropriately selected, and an agitation device, an ultrasonic dispersion device or the like may be appropriately selected, thereby performing favorably the rinsing effectively. Thereafter, toner particles are obtained by performing filtration, decantation, centrifugal separation and the like, and then drying.

After performing the coalescence of the aggregated particles, the rinsing, the solid-liquid separation and the drying may be arbitrarily performed to provide toner particles, and in consideration of the charging property, the particles may be sufficiently substitution-rinsed with ion exchanged water. The solid-liquid separation is not particularly limited, and suction filtration, pressure filtration and the like may be employed from the standpoint of productivity. The drying is also not particularly limited, and freeze drying, flash jet drying, fluidized drying and vibration fluidized drying may be employed.

Surface Modification

The preparation method of the toner for developing an electrostatic image according to the exemplary embodiment may contain, before the preparation of the dispersion, surface-modifying for introducing a carboxyl group to the surface of the carbon black.

The radical generating agent having a carboxyl group may be an azo radical generating agent having a carboxyl group. Specific examples thereof include 2,2'-azobis(N-(2-carboxyethyl)-2-methylpropoionamidine) and a compound represented by the following formula (1).

The temperature, at which the surface modification is performed, may be appropriately selected in consideration of the structure of the radical generating agent having a carboxyl group, the reaction conditions, the intended modification amount and the like, and for example, may be from approximately 40° C. to approximately 200° C.

The solvent used in the surface modification is not particularly limited, and may be appropriately selected in consideration of the boiling point, the stability and the solubility of the radical generating agent having a carboxyl group, and the like. Examples of the solvent include methyl ethyl ketone from the standpoint of the post-treatment.

The ratio of the carbon black and the radical generating agent having a carboxyl group used is not particularly limited, and may be determined depending on the intended amount of the carboxyl group introduced to the surface of the carbon black.

Developer for Electrostatic Image

A developer for an electrostatic image according to the exemplary embodiment is not particularly limited as far as the developer contains the toner for developing an electrostatic image according to the exemplary embodiment, and may further contain appropriate components depending on purposes. For example, a single-component developer for an electrostatic image may be prepared by using the toner for developing an electrostatic image of the exemplary embodiment solely, and a two-component developer for an electrostatic image may be prepared by using the toner with a carrier in combination.

To the single-component developer, such a method may be applied that a charged toner is formed through frictional charge with a developing sleeve or a charging member and used for developing an electrostatic image.

The carrier is not particularly limited, and examples thereof include magnetic material particles, such as iron powder, ferrite powder, iron oxide powder and nickel powder; a resin-coated carrier containing magnetic material particles as a core material coated with a resin, such as a styrene resin, a vinyl resin, an ethylene resin, a rosin resin, a polyester resin and a melamine resin, or wax, such as stearic acid; and a magnetic material dispersed carrier containing magnetic material particles dispersed in a binder resin. Among these, the resin-coated carrier may be preferably used since the charging property of the toner and the resistance of the carrier may be controlled by the constitution of the resin-coated layer.

The ratio of the toner for developing an electrostatic image of the exemplary embodiment mixed in the carrier in the two-component developer for an electrostatic image may be from approximately 2 parts by weight to approximately 10 parts by weight per 100 parts by weight of the carrier. The preparation method of the developer is not particularly limited, and examples of the method include a method of mixing with a V-blender or the like.

Image Forming Method

The toner for developing an electrostatic image of the exemplary embodiment (or the developer for an electrostatic image of the exemplary embodiment) may be applied to an ordinary developing method for an electrostatic image (electrophotographic process).

An image forming method according to the exemplary embodiment may contain: charging an image holding member; forming an electrostatic latent image on a surface of an image holding member; developing the electrostatic latent image formed on the surface of the image holding member, with a toner for developing an electrostatic image or a developer for an electrostatic image, thereby forming a toner image; transferring the toner image formed on the surface of the image holding member, to a surface of a transfer material; and fixing the toner image. The image forming method may further contain cleaning or the like.

The operations constituting the method each are ordinary operation and disclosed, for example, in JP-A-56-40868, JP-A-49-91231 and the like. The image forming method of the exemplary embodiment may be practiced with a known image forming apparatus, such as a duplicator and a facsimile machine.

In the formation of an electrostatic image, an electrostatic image is formed on the surface of the image holding member.

In the developing, the electrostatic latent image is developed with a developer layer on a developer holding member, thereby forming a toner image. The developer layer is not particularly limited as far as the developer layer contains the developer for an electrostatic image of the exemplary embodiment containing the toner for developing an electrostatic image of the exemplary embodiment.

In the transferring, the toner image is transferred to a transfer material.

In the fixing, the toner image transferred to the recording material, such as recording paper, is fixed thereto with a flash fixing device, a heat fixing device or the like, thereby forming a fixed image (duplicated image).

In the cleaning, the developer for an electrostatic image remaining on the image holding member is removed.

The image forming method of the exemplary embodiment may further contain recycling.

In the recycling, the toner for developing an electrostatic image removed and recovered in the cleaning is returned to the developer layer. The image forming method containing the recycling may be practiced with an image forming apparatus having a toner recycling system, such as a duplicator and a facsimile machine. The method may also be applied to a recycling system, in which a toner (developer) is recovered simultaneously with development without cleaning.

An image, such as a duplicated image and a printed image, may be provided through the series of operations.

Image Forming Apparatus

An image forming apparatus according to the exemplary embodiment may contain: an image holding member; a charging unit that charges the image holding member; an exposing unit that exposes the charged image holding member, thereby forming an electrostatic latent image on a surface of the image holding member; a developing unit that develops the electrostatic latent image with a toner for developing an electrostatic image or a developer for an electrostatic image, thereby forming a toner image; a transferring unit that transfers the toner image from the image holding member to a surface of a transfer material; and a fixing unit that fixes the toner image transferred to the surface of the transfer material. In the transferring unit, the transferring operation may be performed twice or more by using an intermediate transfer material. The image forming apparatus may further contain a cleaning unit that removes the toner remaining on the image holding member.

The image holding member and the units described above each may have the structures described above for the image forming method.

The units each may be a know unit for an image forming apparatus. The image forming apparatus of the exemplary embodiment may further contain other units and devices than described above. In the image forming apparatus of the exemplary embodiment, one unit may simultaneously have the functions of plural units.

An example of the image forming apparatus of the exemplary embodiment will be described with reference to FIG. 1, but the exemplary embodiment is not limited to the example. FIG. 1 is a schematic cross sectional view showing an example of an image forming apparatus according to the exemplary embodiment of the invention.

In FIG. 1, an automatic document feeding device U2 is disposed above a platen glass PG at the upper end of an image forming apparatus U1. The automatic document feeding device U2 has an original document tray TG1 having stacked thereon plural original documents Gi to be duplicated. The plural original documents Gi placed on the original document tray TG1 each are sequentially fed to the duplicating position on the platen glass PG and then delivered to an original document delivery tray TG2. The automatic document feeding device U2 is rotatable with respect to the image forming apparatus U1 with a hinge (which is not shown in the FIGURE) extending in the horizontal direction, which is provided at the back end (at the end in the −X direction), and when an original document Gi is placed on the platen glass PG by an operator, the automatic document feeding device U2 is rotated upward.

The image forming apparatus U1 has a user interface U1 for inputting operation commands, such as starting duplication, by an operator. An original document reading device IIT disposed under the transparent platen glass PG of the image forming apparatus U1 has an exposure register sensor (platen register sensor) Sp disposed at a platen register position (OPT position) and an exposure optical system A. The exposure optical system A is controlled for move or stay by the detection signal from the exposure register sensor Sp, and stays at the home position normally. Light reflected from the original document Gi passing through the exposure position on the platen glass PG with the automatic document feeding device U2 or the original document Gi placed manually on the platen glass PG is introduced through the exposure optical system A and converted to electric signals of R (red), G (green) and B (blue) with solid-state image sensing devices COD.

An image processing system IPS converts the electric signals for R, G and B input from the solid-state image sensing devices CCD to image data for K (black), Y (yellow), M (magenta) and C (cyan), stores the image data temporarily, and then outputs the image data as image data for forming a latent image to a laser driving circuit DL at a prescribed timing. The laser driving circuit DL outputs a laser driving signal to a latent image forming device ROS corresponding to the input image data. The operations of the image processing system IPS and the laser driving circuit DL are controlled with a controller C constituted by a microcomputer.

An image holding member PR is rotated in the direction shown by the arrow Ya, and the surface thereof is uniformly charged with a charting device (charging roll) CR, and then scanned for exposure with a laser beam L of the latent image forming device ROS at a latent image writing position Q1, thereby forming an electrostatic latent image. In the case where a full color image is to be formed, electrostatic latent images corresponding to images of four colors, K (black), Y (yellow), M (magenta) and C (cyan), are formed sequentially, and in the case where a monochrome image is to be formed, only an electrostatic latent image corresponding to an image of K (black) is formed.

The surface of the image holding member PR having the electrostatic latent image formed thereon is moved through rotation and passes through a developing area Q2 and a primary transferring area Q3 sequentially. A rotary developing device G has developing devices GK, GY, GM and GC for four colors, K (black), Y (yellow), M (magenta) and C (cyan), which are sequentially moved to the developing area Q2 through rotation of the rotation shaft Ga. The developing devices GK, GY, GM and GC each have a developing roll GR that conveys a developer to the developing area Q2, and develops the electrostatic latent image on the image holding member PR passing through the developing area Q2. Toners of four colors are supplied to the developing vessels of the developing devices GK, GY, GM and GC from toner supplying cartridges attached to cartridge mounting positions Hk, Hy, Hm and Hc, respectively (see FIG. 1). The rotary developing device referred herein is disclosed, for example, in JP-A-2000-131942 and JP-A-2000-231250.

Under the image holding member PR, there are disposed an intermediate transfer belt B, plural belt supporting rolls Rd, Rt, Rw, Rf and T2*a* including a belt driving roll Rd, a tension roll Rt, a working roll Rw, an idler roll (free roll) Rf and a backup roll T2*a*, a primary transfer roll T1, and a belt flame (which is not shown in the FIGURE) for supporting the rolls. The intermediate transfer belt B is supported rotatably with the belt supporting rolls Rd, Rt, Rw, Rf and T2*a*, and is rotated in the direction shown by the arrow Yb upon operating the image forming apparatus.

In the case where a full color image is to be formed, an electrostatic latent image for the first color is formed at the latent image writing position Q1, and a toner image Tn of the first color is formed in the developing area Q2. The toner image Tn is primarily transferred electrostatically to the intermediate transfer belt B with the primary transfer roll T1 upon passing through the primary transferring area Q3. Subsequently, toner images Tn of the second color, the third color and the fourth color are transferred sequentially and accumulated on each other in the similar manner on the intermediate transfer belt B having the toner image Tn of the first color, thereby forming consequently a full color multiple toner image on the intermediate transfer belt B. In the case where a monochrome image is to be formed, only one of the developing devices is used, and a monochrome toner image is primarily transferred to the intermediate transfer belt B. After the primary transfer, the toner remaining on the surface of the image holding member PR is erased with an erasing device JR and removed with an image holding member cleaner CL1.

Under the backup roll T2*a*, a secondary transfer roll T2*b* is disposed movably between the position where the secondary transfer roll T2*b* is remote from the backup roll T2*a* and the position where the secondary transfer roll T2*b* is in contact with the backup roll T2*a*. A secondary transferring device T2 is constituted by the backup roll T2*a* and the secondary transfer roll T2*b*. A secondary transferring area Q4 is formed with the contact area of the backup roll T2*a* and the secondary transfer roll T2*b*. The secondary transfer roll T2*b* is applied with a secondary transfer voltage having the reverse polarity to the charging polarity of the toner used in the developing device G, from an electric power source E, and the electric power source E is controlled with the controller C.

A recording sheet S housed in a paper supplying tray TR1 or TR2 is taken out with a pickup roll Rp at a prescribed timing, separated into one sheet with a separating roll Rs, and conveyed to a register roll Rr with plural feed rolls Ra on a paper supplying path SH1. The recording sheet S conveyed to the register roll Rr is conveyed to the secondary transferring area Q4 through a pre-transferring sheet guide SG1 at a timing corresponding to the movement of the multiple toner image or the monochrome toner image, which has been primarily transferred, to the secondary transferring area Q4. In the secondary transferring area Q4, the secondary transferring device T2 secondarily transfers the toner image on the intermediate transfer belt B electrostatically to the recording sheet S. The toner remaining on the intermediate transfer belt B after the secondary transferring is removed with a belt cleaner CL2. A toner image forming device including PR, CR, G, T1, B and T2 that transfers a toner image to the recording sheet S is constituted by the image holding member PR, the charging roll CR, the developing device G, the primary transfer roll T1, the intermediate transfer belt B, the secondary transfer device T2 and the like.

The secondary transfer roll T2*b* and the belt cleaner CL2 are disposed to be made freely in contact with (i.e., to be freely interchanged between separation from and contact with) the intermediate transfer belt B, and in the case where a color image is to be formed, the secondary transfer roll T2*b* is separated from the intermediate transfer belt B until the non-fixed toner image of the final color has been primarily transferred to the intermediate transfer belt B. A secondary transfer roll cleaner CL3 is disposed to be made freely in contact with the intermediate transfer belt B along with the secondary transfer roll T2*b*. The recording sheet S having the toner image secondarily transferred thereon is conveyed after transferring to a fixing area Q5 with a sheet guide SG2 and a sheet conveying belt BH. The fixing area Q5 is an area where a heating roll Fh and a pressure roll Fp of a fixing device F in contact with each other under pressure (i.e., a nip), and the recording sheet S passing through the fixing area Q5 is fixed under heat with the fixing device F.

In the downstream side of the fixing area Q5 for fixing the toner image on the recording sheet S in FIG. 1, there are disposed a sheet feed roll 16 having a driving roll 16*a* and a driven roll 16*b*, a sheet feed roll Rb having a driving roll Rb1 and a driven roll Rb2, and a sheet delivery path SH2 sequentially in this order. A sheet reversing path SH3 is connected to the sheet delivery path SH2. A switching gate GT1 is provided at a junction point between the sheet delivery path SH2 and the sheet reversing path SH3. The recording sheet S conveyed to the sheet delivery path SH2 is conveyed to a sheet delivery roll Rh with plural feed rolls Ra and delivered to a discharge tray TR3 through a sheet delivery port Ka provided at the upper end of the image forming apparatus U1. The sheet reversing path SH3 is connected to a sheet circulating path SH4, and a mylar gate GT2 constituted by a sheet member is provided at the connecting part thereof. The mylar gate GT2 makes the recording sheet S that is conveyed from the switching gate GT1 through the sheet reversing path SH3 to pass as it is, but directs the recording sheet S that has passed and switchbacked to the sheet circulating path SH4. The recording sheet S conveyed to the sheet circulation path SH4 is again conveyed to the transferring area Q4 through the paper supplying path SH1. A sheet conveying path SH is constituted by the elements denoted by SH1 to SH4. A sheet conveying device US is constituted by the sheet conveying path SH and the rolls Ra, Rh and the like having a sheet conveying function disposed thereon.

Toner Cartridge and Process Cartridge

A toner cartridge according to the exemplary embodiment is a toner cartridge containing at least the toner of the exemplary embodiment. The toner cartridge of the exemplary embodiment may contain the toner of the exemplary embodiment in the form of a developer for an electrostatic image.

A process cartridge according to the exemplary embodiment contains: a developing unit that develops an electrostatic latent image formed on a surface of an image holding member, with the toner for developing an electrostatic image or the developer for an electrostatic image, and at least one member selected from an image holding member, a charging unit that charges the surface of the image holding member, and a cleaning unit that removes a toner remaining on the surface of the image holding member, and contains at least the toner for developing an electrostatic image of the exemplary embodiment or the developer for an electrostatic image of the exemplary embodiment.

The toner cartridge of the exemplary embodiment may be attachable to and detachable from an image forming apparatus. Accordingly, the toner cartridge of the exemplary embodiment containing the toner of the exemplary embodiment may be applied to an image forming apparatus having such a constitution that a toner cartridge is attachable thereto and detachable therefrom.

The toner cartridge may be a cartridge that contains the toner and a carrier, or in alternative, a cartridge containing a carrier may be provided separately from a cartridge containing the toner.

The process cartridge of the exemplary embodiment may be detachable to and attachable from an image forming apparatus.

The process cartridge of the exemplary embodiment may further contain other members, such as an erasing unit, depending on necessity.

The toner cartridge and the process cartridge each may employ a known structure, and for example, JP-A-2008-209489 and JP-A-2008-233736 may be referred therefor.

Example

The invention will be described in more detail with reference to examples below, but the invention is not limited to the examples. In the following description, the term "part" shows "part by weight" unless otherwise indicated.

Preparation of Carbon Black Dispersions 1 to 5

(Control of Surface Carboxyl Group Density of Carbon Black)

1,000 parts of a 25% by weight methyl ethyl ketone (MEK) dispersion of carbon black (available from Cabot Speciality Chemicals, Inc.) is placed in a four-neck flask equipped with a nitrogen introduction tube, a condenser, a stirrer and a thermocouple, and heated to 60° C. over a hot water bath in a nitrogen atmosphere under stirring at 180 rpm, to which 0.5 part of 4,4'-bisazo(4-cyanopentanoic acid) (available from Wako Pure Chemical Industries, Ltd.) is added, followed by maintaining at 60° C. for 30 minutes. The dispersion is sampled in a suitable amount (carbon black 1), then 0.5 part of 4,4'-bisazo(4-cyanopentanoic acid) is again added, followed by maintaining at 60° C. for 30 minutes, and the dispersion is sampled in a suitable amount (carbon black 2). The same operation is repeated to provide carbon black 3 to 5.

To the samples, carbon black 1 to 5, the same weight of deionized water (DIW) is added dropwise under stirring, MEK is evaporated by exhaust-drying, thereby providing carbon black dispersions 1 to 5.

The carbon black dispersions are each controlled to a solid concentration of 20% by weight with deionized water (DIW).

Preparation of Polyester Resin Particle Dispersion 1

| | |
|---|---|
| Propylene oxide 2-mol adduct of bisphenol A | 310 parts |
| Terephthalic acid | 110 parts |
| Trimellitic anhydride | 6 parts |
| Fumaric acid | 12 parts |
| Dodecenylsuccinic acid | 54 parts |
| $Ti(OBu)_4$ (tetrabutoxytitanium) | 0.05 part |

The aforementioned materials are placed in a three-neck flask having been dried by heating, the interior of the flask is vacuumed and charged with nitrogen gas to make an inert atmosphere, and the mixture is refluxed at 180° C. under mechanical stirring for 5 hours. Thereafter, the mixture is slowly heated to 240° C. while water generated in the reaction system is distilled off under reduced pressure. The dehydration condensation reaction is further performed at 240° C. for 2 hours, and when a viscous material is obtained, the molecular weight thereof is confirmed by gel permeation chromatography (GPC). When the weight average molecular weight reaches 24,000, the distillation under reduced pressure is terminated to provide an amorphous polyester resin (1). The amorphous polyester resin (1) is amorphous and has a glass transition temperature of 60° C. and an acid value of 12.5 mgKOH/g.

100 parts of the amorphous polyester resin (1), 48 parts of ethyl acetate, 25 parts of isopropyl alcohol and 5 parts of aqueous ammonia are placed in a separable flask, and after sufficiently mixed and dissolved, ion exchanged water is added dropwise thereto at a liquid feeding rate of 8 g/min with a metering pump under stirring and heating to 40° C. After the liquid is turbid to white, the liquid feeding rate is increased to 25 g/min. for phase inversion, and the dropwise addition is terminated when the liquid feeding amount reaches 135 parts. Thereafter, the solvent is removed under reduced pressure, thereby providing an amorphous polyester resin particle dispersion 1. The obtained polyester resin particles have a volume average particle size of 140 nm, and the solid concentration of the polyester resin particles is 38%.

Preparation of Polyester Resin Particle Dispersion 2

A polyester resin (2) having a glass transition temperature of 58° C. and an acid value of 10 mgKOH/g is obtained in the same synthesis manner except that in the materials of the polyester resin (1), the amount of terephthalic acid is changed to 114 parts, and the amount of trimellitic anhydride is changed to 2 parts.

A polyester resin particle dispersion 2 having a volume average particle size of 150 nm is obtained in the same emulsification manner.

Preparation of Polyester Resin Particle Dispersion 3

A polyester resin (3) having a glass transition temperature of 63° C. and an acid value of 20 mgKOH/g is obtained in the same synthesis manner except that in the materials of the polyester resin (1), the amount of terephthalic acid is changed to 100 parts, and the amount of trimellitic anhydride is changed to 16 parts.

A polyester resin particle dispersion 3 having a volume average particle size of 170 nm is obtained in the same emulsification manner.

Preparation of Polyester Resin Particle Dispersion 4

A polyester resin (4) having a glass transition temperature of 58° C. and an acid value of 5 mgKOH/g is obtained in the same synthesis manner except that in the materials of the polyester resin (1), the amount of terephthalic acid is changed to 116 parts, and the amount of trimellitic anhydride is changed to 0 part.

A polyester resin particle dispersion 4 having a volume average particle size of 180 nm is obtained in the same emulsification manner.

Preparation of Polyester Resin Particle Dispersion 5

A polyester resin (5) having a glass transition temperature of 63° C. and an acid value of 20 mgKOH/g is obtained in the same synthesis manner except that in the materials of the polyester resin (1), the amount of terephthalic acid is changed to 95 parts, and the amount of trimellitic anhydride is changed to 21 parts.

A polyester resin particle dispersion 5 having a volume average particle size of 170 nm is obtained in the same emulsification manner.

Preparation of Releasing Agent Particle Dispersion

| | |
|---|---|
| Ester wax (WEP5, available from NOF Corporation) | 50 parts |
| Anionic surfactant (Neogen RK, available from Daiichi Kogyo Seiyaku Co., Ltd.) | 5 parts |
| Ion exchanged water | 200 parts |

The aforementioned materials are heated to 110° C., dispersed with a homogenizer (Ultra-Turrax T50, available from IKA Works, Inc.), and further dispersed with Manton-Gaulin High-pressure Homogenizer (available from Gaulin), thereby preparing a releasing agent dispersion having an average particle size of 0.24 μM (releasing agent concentration: 23%).

Preparation Example of Toners

Toners for developing an electrostatic image of Examples 1 to 5 and Comparative Examples 1 to 4 are prepared by using the polyester resin particle dispersions and the carbon black dispersions shown in Table 1 by the following manner.

| | |
|---|---|
| Polyester resin particle dispersion | 63 parts |
| Carbon black dispersion | 5 parts |
| Anionic surfactant (Dowfax 2A1, 20% aqueous solution, available from Dow Chemical Company) | 4 parts |
| Releasing agent particle dispersion | 7 parts |

For preparing core particles, the polyester resin particle dispersion and the anionic surfactant among the aforementioned materials, and 100 parts by weight of ion exchanged water are placed in a polymerization tank equipped with a pH meter, an agitation blade and a thermometer, and agitated at 140 rpm for 15 minutes. The carbon black dispersion and the releasing agent particle dispersion are added and mixed therewith, and then a 0.3 M nitric acid aqueous solution is added to the raw material mixture to adjust pH 4.8. 0.5 part by weight of a 10% by weight polyaluminum chloride nitric acid aqueous solution (available from Asada Chemical Industry Co., Ltd.) as an aggregating agent is added dropwise thereto under application of a shearing force by agitating at 4,000 rpm with a homogenizer (Ultra-Turrax, available from IKA Works, Inc.). The viscosity is increased during the dropwise addition of the aggregating agent, and the rate of the dropwise addition is decreased to prevent the aggregating agent from being localized. After completing the dropwise addition of the aggregating agent, the mixture is further agitated at an increased rotation number of 5,000 rpm for 5 minutes, thereby mixing the aggregating agent and the raw material mixture.

An agitation device and a mantle heater are provided, and while the slurry of the raw material mixture is sufficiently agitated, the slurry is heated to 40° C. at a rate of 1.0° C. per minute, maintained at 40° C. for 30 minutes, and then heated at a rate of 0.1° C. per minute, during which the particle size is measured at every 10 minutes with Multisizer II (aperture size: 50 μm, available from Beckman Coulter, Inc.), and when the volume average particle size of the particles reaches 6.0 μm, the pH is made 8.0 with a 5% by weight sodium hydroxide aqueous solution. Thereafter, the temperature is increased to 85° C. at a rate of 1° C. per minute while maintaining pH 8.0 at every 5.0° C., and then maintained at 85° C. The shape and the surface property of the particles are observed with an optical microscope and a scanning electron microscope (FE-SEM) at every 30 minutes. The particles become substantially spherical after lapsing 3.5 hours, and then the temperature is decreased to 20° C. at a rate of 10° C. per a minute for solidifying the particles. The reaction product is then filtered to separate the toner slurry and the filtrate.

The toner slurry is sufficiently rinsed with ion exchanged water, and then dried with an air flow dryer, thereby providing toner mother particles. 1 part by weight of silica particles, which are inorganic particles as an external additive, are added to 100 parts by weight of the obtained toner mother particles, and they are mixed for external addition with a Henschel mixer (FM5C, available from Mitsui Mining Co., Ltd.), thereby preparing toners (black toners) having a volume average particle size of 6.1 μm of Examples 1 to 5 and Comparative Examples 1 to 4.

The silica particles used have an average particle size of 110 nm and are prepared by performing granulation by a sol-gel method and a hydrophobic treatment with HMDS (hexamethyldisilazane).

TABLE 1

| | Polyester resin particle dispersion | Acid value of polyester resin (mgKOH/g) | Surface carboxyl group density of polyester resin particles (mol/m$^2$) | Carbon black dispersion | Surface carboxyl group density of carbon black (mol/m$^2$) |
|---|---|---|---|---|---|
| Example 1 | 1 | 12.5 | $3 \times 10^{-6}$ | 3 | $5.5 \times 10^{-6}$ |
| Example 2 | 2 | 10 | $2.5 \times 10^{-6}$ | 2 | $2 \times 10^{-6}$ |
| Example 3 | 3 | 20 | $5.1 \times 10^{-6}$ | 4 | $8 \times 10^{-6}$ |
| Comparative Example 1 | 1 | 12.5 | $3 \times 10^{-6}$ | 1 | $1 \times 10^{-6}$ |
| Comparative Example 2 | 1 | 12.5 | $3 \times 10^{-6}$ | 5 | $9.5 \times 10^{-6}$ |
| Comparative Example 3 | 4 | 5 | $1.4 \times 10^{-6}$ | 2 | $2 \times 10^{-6}$ |

TABLE 1-continued

| | Polyester resin particle dispersion | Acid value of polyester resin (mgKOH/g) | Surface carboxyl group density of polyester resin particles ($mol/m^2$) | Carbon black dispersion | Surface carboxyl group density of carbon black ($mol/m^2$) |
|---|---|---|---|---|---|
| Comparative Example 4 | 5 | 25 | $6 \times 10^{-6}$ | 2 | $2 \times 10^{-6}$ |
| Example 4 | 2 | 10 | $2.5 \times 10^{-6}$ | 4 | $8 \times 10^{-6}$ |
| Example 5 | 3 | 20 | $5.1 \times 10^{-6}$ | 2 | $2 \times 10^{-6}$ |

Preparation of Developer for Electrostatic Image 15 parts of a resin obtained by copolymerizing styrene, methyl methacrylate and isobutyl methacrylate (weight ratio: 30/60/10) (available from Soken Chemical & Engineering Co., Ltd., molecular weight: 82,000) is dissolved in 500 parts of toluene, to which 100 parts of ferrite particles (volume average particle size: 35 μm), and the mixture is distilled under reduced pressure in a kneader, thereby preparing a resin-coated carrier.

36 parts of the toner and 414 parts of the carrier are placed in a V-blender and agitated for 20 minutes, and the mixture is sieved with a mesh of 212 μm, thereby preparing a developer.

Evaluation

The toners of Examples 1 to 5 and Comparative Examples 1 to 4 are evaluated in the following manner.

Evaluation of Granulation Property

It is determined as to whether or not a problem occurs upon preparing the toner in Preparation Example of the toner.

When a serious problem occurs on preparing the toner, the preparation of the toner is aborted, and the evaluation of transferring property under a high temperature and high humidity environment is not performed.

Evaluation of Transferring Property under High Temperature and High Humidity Environment (35° C., 85% RH)

The developer thus prepared is charged in a modified machine of Apeos-Port II C4300 (available from Fuji Xerox Co., Ltd.), which has been modified to enable to terminate the developing and transferring process at an arbitrary timing, and the amount of light for development is controlled to develop the toner in a solid patch shape on the photoconductor through the developing process to a toner amount per unit area of 2.7 $g/m^2$. The operation of controlling the amount of light is performed for every evaluations of the toners.

The toner patch thus obtained is then transferred from the photoconductor to the intermediate transfer belt. The photoconductor that has not yet been cleaned is taken out, and a transparent adhesive tape is attached to the photoconductor at the position where the toner patch is formed, and then released, thereby recovering the toner that is not transferred. The toner thus recovered is attached to a white plate along with the adhesive tape, and the state of coloration with the toner is visually observed for evaluation of the transferring property.

The evaluation standard is as follows.

A: The coloration with the toner on the white plate is not visually observed.

$B^+$: The coloration with the toner is slightly observed visually, but there is no practical problem.

$B^-$: The coloration with the toner is observed visually, which causes a practical problem.

C: The coloration with the toner is observed, and the carrier is also developed, or serious coloration with the toner is observed.

Evaluation Results

Example 1

The polyester resin used has an acid value of 12.5 mgKOH/g, and the carbon black used has a surface carboxyl group density of $5.5\times10^{-6}$ $mol/m^2$. No problem occurs in granulation. The evaluation result of transferring property under a high temperature and high humidity environment is A.

Example 2

The polyester resin used has an acid value of 10 mgKOH/g, and the carbon black used has a surface carboxyl group density of $2\times10^{-6}$ $mol/m^2$. No problem occurs in granulation. The evaluation result of transferring property under a high temperature and high humidity environment is $B^+$.

Example 3

The polyester resin used has an acid value of 20 mgKOH/g, and the carbon black used has a surface carboxyl group density of $8\times10^{-6}$ $mol/m^2$. No problem occurs in granulation. The evaluation result of transferring property under a high temperature and high humidity environment is $B^+$.

Example 4

The polyester resin used has an acid value of 10 mgKOH/g, and the carbon black used has a surface carboxyl group density of $8\times10^{-6}$ $mol/m^2$. No problem occurs in granulation. The evaluation result of transferring property under a high temperature and high humidity environment is $B^+$.

Example 5

The polyester resin used has an acid value of 20 mgKOH/g, and the carbon black used has a surface carboxyl group density of $2\times10^{-6}$ $mol/m^2$. No problem occurs in granulation. The evaluation result of transferring property under a high temperature and high humidity environment is $B^+$.

Comparative Example 1

The polyester resin used has an acid value of 12.5 mgKOH/g, and the carbon black used has a surface carboxyl group density of $1\times10^{-6}$ $mol/m^2$. No problem occurs in granulation. The evaluation result of transferring property under a high temperature and high humidity environment is C. It is considered that the result occurs due to aggregation of the carbon black in the toner.

Comparative Example 2

The polyester resin used has an acid value of 12.5 mgKOH/g, and the carbon black used has a surface carboxyl group density of $9.5\times10^{-6}$ mol/m$^2$. A problem occurs in granulation. The carbon black is deposited on the surface of the toner, and the filtrate before rinsing is turbid to black. It is decided that the preparation of the toner is not performed properly. The evaluation of transferring property under a high temperature and high humidity environment is not performed.

Comparative Example 3

The polyester resin used has an acid value of 5 mgKOH/g, and the carbon black used has a surface carboxyl group density of $2\times10^{-6}$ mol/m$^2$. A problem occurs in granulation. The stability of the resin particles in the aqueous medium is insufficient, and the particle size is grown large to form coarse powder. The preparation of the toner is aborted, and the evaluation of transferring property under a high temperature and high humidity environment is not performed.

Comparative Example 4

The polyester resin used has an acid value of 25 mgKOH/g, and the carbon black used has a surface carboxyl group density of $2\times10^{-6}$ mol/m$^2$. A problem occurs in granulation. The stability of the resin particles in the aqueous medium is too large, and the resin particles are not aggregated to make the filtrate turbid to white, which is not suitable for preparation of the toner. The evaluation of transferring property under a high temperature and high humidity environment is not performed.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention defined by the following claims and their equivalents.

What is claimed is:

1. A toner for developing an electrostatic image,
comprising a binder resin having an acid value of from approximately 10 mgKOH/g to approximately 20 mgKOH/g and carbon black having a surface carboxyl group density of from approximately $2\times10^{-6}$ mol/m$^2$ to approximately $8\times10^{-6}$ mol/m$^2$, and
being prepared in an aqueous medium.

2. The toner for developing an electrostatic image according to claim 1, wherein the surface carboxyl group density of the carbon black is from approximately $3\times10^{-6}$ mol/m$^2$ to approximately $7\times10^{-6}$ mol/m$^2$.

3. The toner for developing an electrostatic image according to claim 1, wherein the surface carboxyl group density of the carbon black is from approximately $4\times10^{-6}$ mol/m$^2$ to approximately $6\times10^{-6}$ mol/m$^2$.

4. The toner for developing an electrostatic image according to claim 1, wherein the amount of the carbon black is from approximately 0.1 part by weight to approximately 20 parts by weight per 100 parts by weight of the toner.

5. The toner for developing an electrostatic image according to claim 1, wherein the acid value of the binder resin is from approximately 12 mgKOH/g to approximately 15 mgKOH/g.

6. A method for preparing the toner for developing an electrostatic image according to claim 1, comprising:
preparing an aqueous dispersion containing resin particles having an acid value of from approximately 10 mgKOH/g to approximately 20 mgKOH/g and carbon black having a surface carboxyl group density of from approximately $2\times10^{-6}$ mol/m$^2$ to approximately $8\times10^{-6}$ mol/m$^2$;
aggregating the resin particles and the carbon black, thereby providing aggregated particles, in the aqueous dispersion; and
coalescing the aggregated particles by heating.

7. The method for preparing the toner for developing an electrostatic image according to claim 6, wherein the amount of the carbon black is from approximately 0.1 part by weight to approximately 20 parts by weight per 100 parts by weight of the toner.

8. The method for preparing the toner for developing an electrostatic image according to claim 6, wherein the acid value of the binder resin is from approximately 12 mgKOH/g to approximately 15 mgKOH/g.

9. A developer for an electrostatic image comprising the toner for developing an electrostatic image according to claim 1, and a carrier.

10. The developer for an electrostatic image according to claim 9, wherein the surface carboxyl group density of the carbon black in the toner is from approximately $4\times10^{-6}$ mol/m$^2$ to approximately $6\times10^{-6}$ mol/m$^2$.

11. A process cartridge
comprising a developer holding member,
being attachable to and detachable from an image forming apparatus, and
containing the developer for an electrostatic image according to claim 9.

12. An image forming method comprising:
forming an electrostatic latent image on a surface of an image holding member;
developing the electrostatic latent image formed on the surface of the image holding member, with a developer containing a toner, thereby forming a toner image;
transferring the toner image to a surface of a transfer material; and
fixing the toner image transferred to the surface of the transfer material,
the developer being the developer for an electrostatic image according to claim 9.

13. An image forming apparatus comprising:
an image holding member;
a charging unit that charges the image holding member;
an exposing unit that exposes the charged image holding member, thereby forming an electrostatic latent image on a surface of the image holding member;
a developing unit that develops the electrostatic latent image with a developer containing a toner, thereby forming a toner image;
a transferring unit that transfers the toner image from the image holding member to a surface of a transfer material; and
a fixing unit that fixes the toner image transferred to the surface of the transfer material,
the developer being the developer for an electrostatic image according to claim 9.

14. A toner cartridge being attachable to and detachable from an image forming apparatus, comprising the toner for developing an electrostatic image according to claim 1.

15. The toner cartridge being attachable to and detachable from an image forming apparatus according to claim 14, wherein the surface carboxyl group density of the carbon black in the toner is from approximately $4\times10^{-6}$ mol/m$^2$ to approximately $6\times10^{-6}$ mol/m$^2$.

16. A process cartridge comprising a developer holding member, being attachable to and detachable from an image forming apparatus, and containing the toner for developing an electrostatic image according to claim 1.

17. The process cartridge according to claim 16, wherein the surface carboxyl group density of the carbon black in the toner is from approximately $4\times10^{-6}$ mol/m$^2$ to approximately $6\times10^{-6}$ mol/m$^2$.

18. An image forming method comprising:

forming an electrostatic latent image on a surface of an image holding member;

developing the electrostatic latent image formed on the surface of the image holding member, with a developer containing a toner, thereby forming a toner image;

transferring the toner image to a surface of a transfer material; and fixing the toner image transferred to the surface of the transfer material, the toner being the toner for developing an electrostatic image according to claim 1.

19. The image forming method according to claim 18, wherein the surface carboxyl group density of the carbon black in the toner is from approximately $4\times10^{-6}$ mol/m$^2$ to approximately $6\times10^{-6}$ mol/m$^2$.

20. An image forming apparatus comprising:

an image holding member;

a charging unit that charges the image holding member;

an exposing unit that exposes the charged image holding member, thereby forming an electrostatic latent image on a surface of the image holding member;

a developing unit that develops the electrostatic latent image with a developer containing a toner, thereby forming a toner image;

a transferring unit that transfers the toner image from the image holding member to a surface of a transfer material; and a fixing unit that fixes the toner image transferred to the surface of the transfer material, the toner being the toner for developing an electrostatic image according to claim 1.

* * * * *